US006640811B2

(12) United States Patent
Cho

(10) Patent No.: US 6,640,811 B2
(45) Date of Patent: Nov. 4, 2003

(54) PORTABLE NAIL CARE DEVICE

(76) Inventor: Yong Hoon Cho, 604 Murfield Ct., Fullerton, CA (US) 92835

( * ) Notice: Subject to any disclaimer, the term of this patent is extended or adjusted under 35 U.S.C. 154(b) by 7 days.

(21) Appl. No.: 10/010,619

(22) Filed: Dec. 3, 2001

(65) Prior Publication Data

US 2003/0102002 A1 Jun. 5, 2003

(51) Int. Cl.[7] ..... A45D 29/05
(52) U.S. Cl. ..... 132/73.6
(58) Field of Search ..... 132/73.6, 73.5, 132/75, 75.3, 75.6, 76.4, 75.8; 433/125, 126

(56) References Cited

U.S. PATENT DOCUMENTS 3,183,538 A * 5/1965 Hubner ..... 132/73.6
4,137,926 A * 2/1979 Pao ..... 132/73.6
4,643,207 A * 2/1987 Grahame ..... 132/73.6
4,854,334 A * 8/1989 Su ..... 132/73.6
5,033,485 A * 7/1991 Hauerwas et al. ..... 132/73.6
5,640,979 A * 6/1997 Trenary ..... 132/73.6
6,503,082 B1 * 1/2003 Takahashi ..... 433/125

* cited by examiner

*Primary Examiner*—John J. Wilson
*Assistant Examiner*—Robyn Kieu Doan
(74) *Attorney, Agent, or Firm*—Maria Erlinda C. Sarno

(57) ABSTRACT

A nail care device assembly having a handle housing a power driven motor, a spindle connected to the shaft of the motor for receiving a removable grooming accessory, the main feature residing on a covered holder for storing a number of grooming accessories. The covered holder is attachable to the handle for portability and is easily detachable from the handle whenever grooming of the fingernails is initiated.

18 Claims, 10 Drawing Sheets

PORTABLE NAIL CARE DEVICE

This invention relates to a one piece portable nail care device assembly having a variety of fingernail grooming accessories stored in a covered compact casing.

BACKGROUND

Several manicuring devices for fingernail grooming are known. Fingernail grooming includes trimming, shaping, filing, cuticle removing, cuticle pushing, polishing, buffing and cleaning. These devices usually includes a casing enclosing a motor for operating a detachable grooming accessory or hereinafter also referred to as bit. These accessories or bits are not housed with the motor. Only one bit can be left attached with the motor. Consequently, the other accessories or bits are left loose individually. The latter pose the problem of losing these bits which entail cost to replace. This problem may be solved by providing another casing for the accessories which now requires one to carry two casings instead of one to be able to do several desired grooming functions. The problem with this is to remember bringing both casings. An alternate approach is one proposed by U.S. Pat. No. 4,137,926 which stores the casing holding the motor inside a larger casing holding the bits. Consequently, the casing of this invention is of a size not easily carried in a ladies' purse or bag especially when one already carries in it cosmetics, a telephone, a wallet, a palm, a brush and others.

It is therefore an object of this invention to provide a portable nail care device having the fingernail grooming accessories or bits stored in the same casing as the motor.

It is also an object of this invention to provide a nail care device that is capable of being manufactured at a low cost.

It is a further object of this invention to provide a nail care device that is simple to use and operate.

SUMMARY OF THE INVENTION

A compact one piece nail care device assembly comprising a handle housing a motor having an output shaft and a power supply; a spindle connected to the shaft for receiving a removable grooming accessory referred to as bit having a bit head and a bit stem; a bit holder attaching on top of the handle for carrying and storing the bit; a cover for the bit holder to secure the bit inside the bit holder; a switch to trigger the device; and, means for attaching parts of the nail care device assembly together. The power to run the motor may be supplied by a regular nonrechargeable battery, a rechargeable battery or by plugging into a current supply. The spindle may be covered by a spindle cover to shield the shaft and the spindle. The bit holder may attach to the spindle cover instead of the handle when a spindle cover is used. The main feature of the claimed invention is the covered bit holder having a plurality of tubular openings attached to the handle or the spindle cover for carrying the and storing the bit.

DETAILED DESCRIPTION OF THE INVENTION

Figure 1:
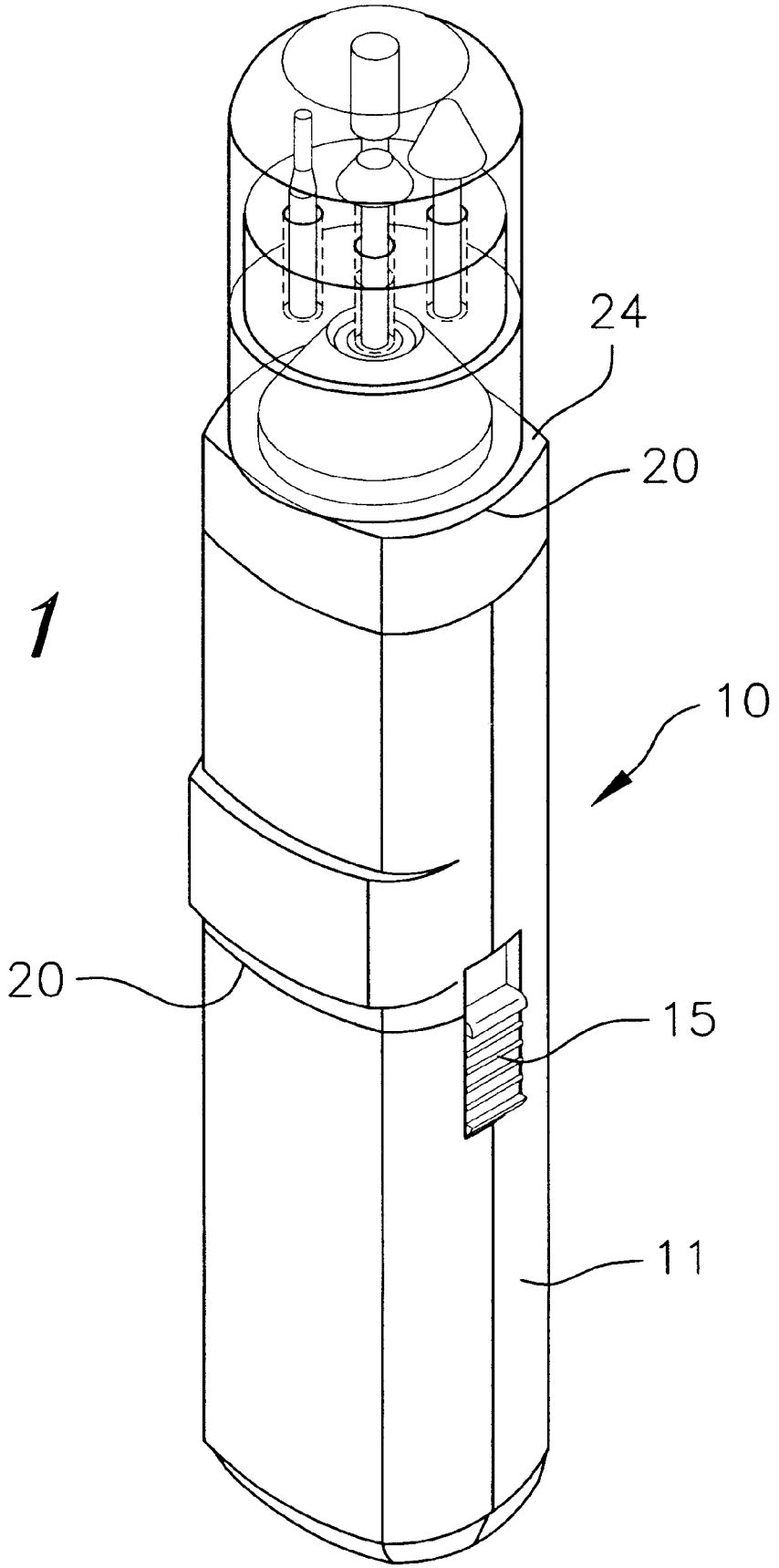
FIG. 1 is a perspective view of the nail care device.
Figure 2:
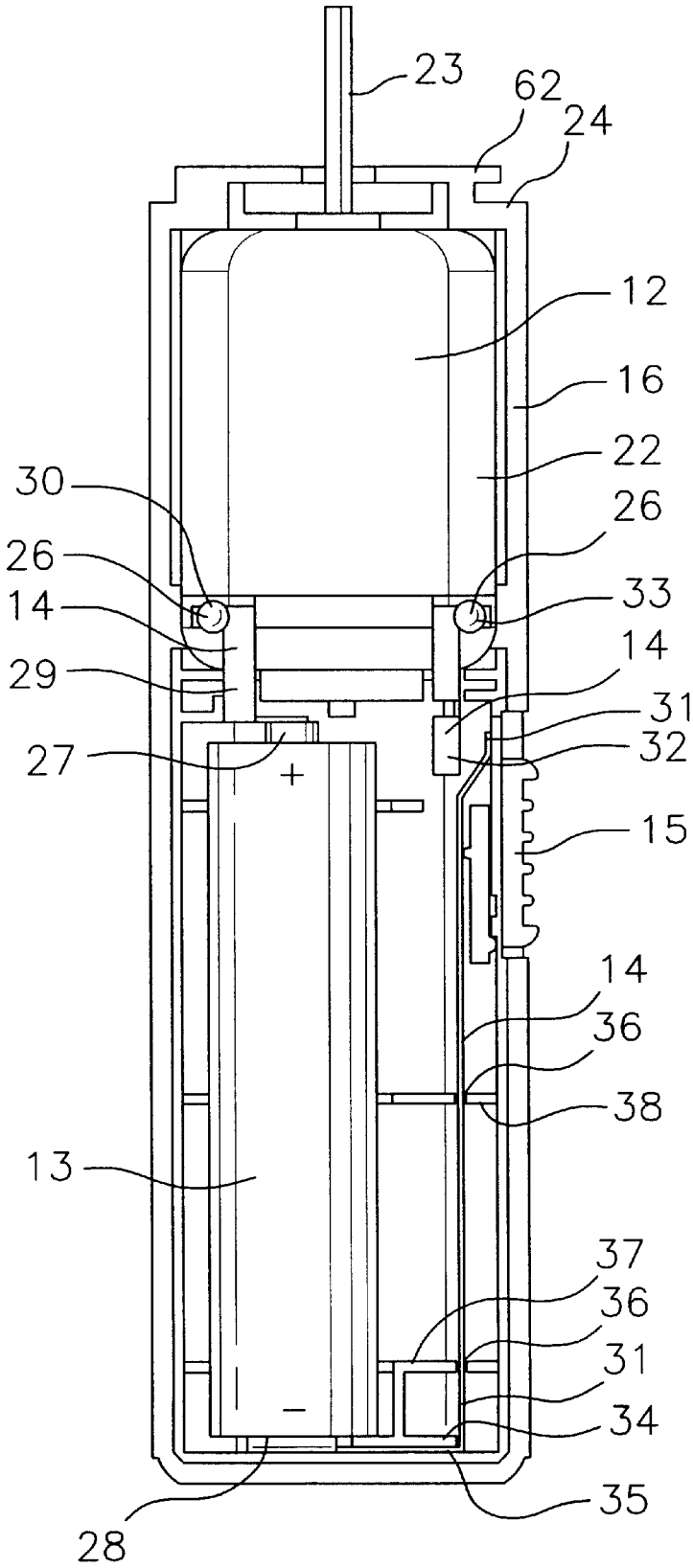
FIG. 2 is a front plan view of the nail care device with front cover off showing the parts inside the handle.

FIG. 1 shows the nail care device 10 according to the preferred embodiment of the invention. The nail care device has an elongated handle 11 housing an electric motor 12 and a power supply assembly for driving the electric motor. Suitable electric motors for use with the nail care device are commercially available such as one sold by Shanghai Dingling Micromotor Factory, model no. PZB-131-2270. The power supply assembly includes a power source, preferably a battery 13 connected in series by conducting means 14 to a triggering device, an on/off control switch 15, as shown in FIG. 2. The power source may also be supplied by plugging the device to an electric current. The battery may be a regular nonrechargeable battery or a rechargeable battery. In the latter, a recharging base with a power cord for plugging into a conventional socket is needed which can conveniently function as a stand when the device is not in use or the battery is being recharged. For the nail care device with a recharging battery, a pair of recharging pads is usually placed near the bottom of the handle 11 to provide electrical connections for recharging the battery. The recharging pads connects to the positive and negative terminals of the rechargeable battery/s to allow for recharging when the device is placed on the recharging base. For illustrative purpose, the claimed invention herein will use a conventional battery as the power source.

Figure 3:
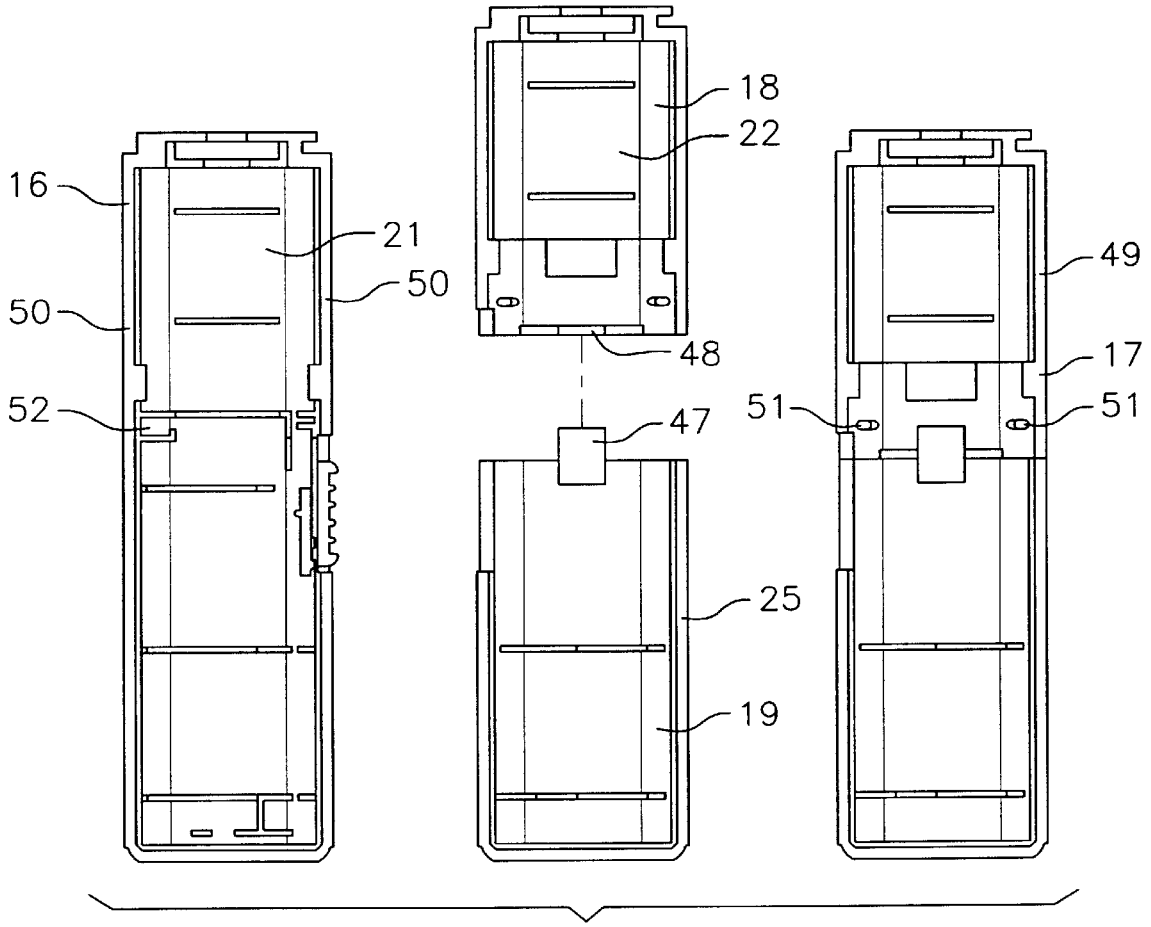
FIG. 3 shows the interior surface of the different pieces making up the back and front pieces of the handle.
Figure 4A:
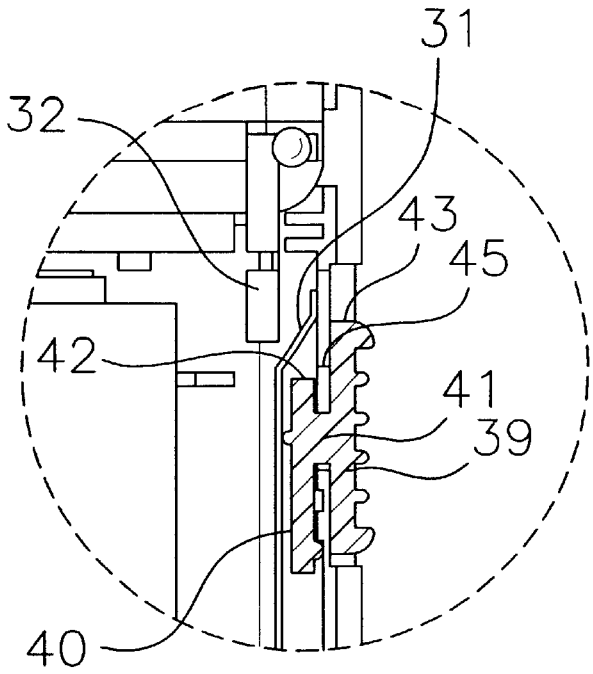
FIG. 4A is a blown up view of the switch in the off position.
Figure 4B:
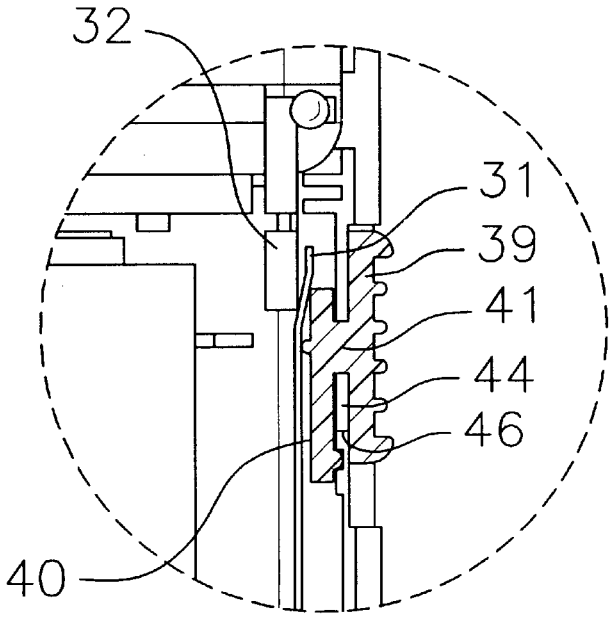
FIG. 4B is a blown up view of the switch in the on position.

As shown in FIG. 3, the handle may be made up of two pieces, a back half piece 16 and a front half piece 17. Preferably, the front half piece 17 is further subdivided into two pieces, an upper front half piece 18 and a lower front half piece 19. The handle is preferably of a molded plastic construction. The handle may be shaped into any ergonometric design. One such design is shown in FIGS. 1, 5, 7 and 8 wherein the handle is rectangularly shaped with rounded concaved sides 20 instead of flat for easily and comfortably gripping the handle. The internal surface of the handle is convex 21 to result in a hollow interior when the pieces of the handle are assembled together. The construction of the back half piece 16 as shown in FIGS. 2 and 3 shows the preferable housing position of the motor 12, the battery 13, the conducting means 14 and the switch 15. The location of these parts may be varied according to ones preference. As shown, the motor is preferably located on the upper end 22 of the handle because the motor 12 used herein has an output shaft 23 extending axially from the top of the motor. Consequently, as shown in FIG. 2, the shaft extends from the top surface 24 of the handle. The power supply assembly is placed on the lower end 25 of the handle. To maintain compactness, electrical contact points 26 are placed on the lower end of the motor 12. These contact points are electrically connected in series with the corresponding positive 27 and negative 28 terminals of the battery 13 by means of conducting means 14 which may be a conducting wire but is preferably a flexible conducting strip. The conducting means 14 which are conducting strips as preferably used herein, are identified separately into several parts, a conducting strip 29 which is connected to the positive contact point 30 of the motor 12; conducting strip 31 which is connected to the negative terminal 28 of the battery 13; and, conducting strip 32 which is connected to the negative contact point 33 of motor 12. To keep the conducting strip 31 in position, the conducting strip is clipped into platform 34 and then fastened by the same platform 34 at the bottom 35 space of the back half piece 16. The conducting strip 31 extends upwards passing through slits 36 of a lower rib 37 and an upper rib 38. The tip of the conducting strip 31 is at the same level as the conducting strip 32 to facilitate contacting these two strips together. The powering of the motor is controlled by the on/off switch 15 preferably located on a lateral side of the handle at the negative terminal side of the motor as shown in FIG. 2. The motor is turned off when the negative terminal 28 of the battery is disconnected from the negative contact point 33 of the motor as shown in FIGS. 2 and 4A. The switch 15 is made up of two parallel rectangular strips, an outer strip 39 and an inner strip 40 joined together by a bridge or joint 41 as shown in FIGS. 4A and 4B. The inner strip is generally more slender than the outer strip with the top end 42 lower than the top end 43 of the outer strip 39. The bridge connecting the two strips is located along a longitudinal track 44 having an upper end 45 and a lower end 46 which controls the extent of advancement of the inner strip 40. When the outer strip is slid downwards to the off position as shown in FIG. 4A, the outer strip 39 consequently carries with it the inner strip 40, thereby preventing the inner strip from pushing the conducting strip 31 into contact with the conducting strip 32. When the outer strip 39 is slid upwards to the on position as shown in FIG. 4B, the inner strip 40 is pushed upwards which then in turn push the conducting strip 31 into contact with the conducting strip 32. The outer surface of the outer strip 39 is preferably gridded to provide a better grip on the switch. The conducting strip is made of any conducting metal, preferably those that are flexible such as zinc or silver plated brass or phosphor bronze.

The front half piece 17 is preferably made up of two detachable pieces, an upper front cover 18 and a lower front cover 19. This allows one to selectively remove the lower front cover, leaving the upper front cover when replacing the battery. The two front pieces may be connected by means known in the art such as friction fit, snap fit and the like. The mechanism used herein is to anchor a protruding hook 47 from the inner surface of the lower front cover 19 into a matching lip 48 on the inside surface of the upper front cover 18. This mechanism allows reversibly connecting and disconnecting the front two pieces together. The front half piece 17 and the back half piece 16 are preferably snapped together to form the handle after the interior components are assembled. Other means of fastening the two pieces are known. Snapping allows the peripheral edges 49 of the front half piece 17 to rest at a recessed track 50 on the peripheral edges of the back half piece 16 and allow a pin 51 protruding from the inside surface of the front half piece to engage fittingly into an opening 52 at the inside surface of the back half piece. The side surfaces of the of the connected front and back pieces must align well after snapping. The handle is preferably made of plastic material but other materials may also be used such as wood and metal.

Figure 5:
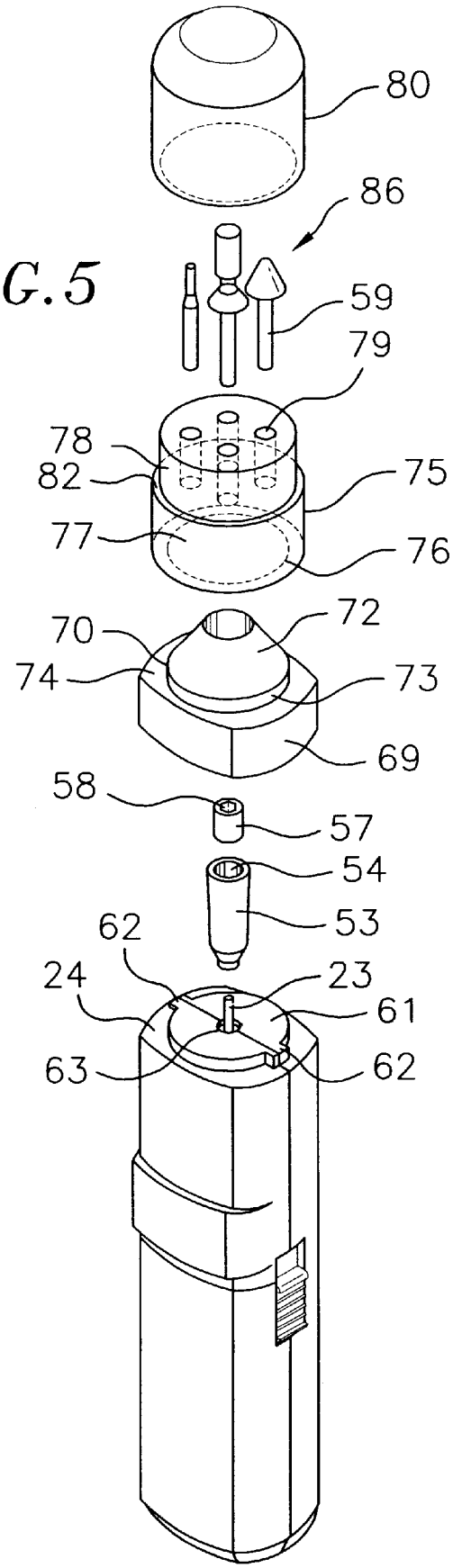
FIG. 5 is an exploded view of the components of the nail care device.
Figure 6:
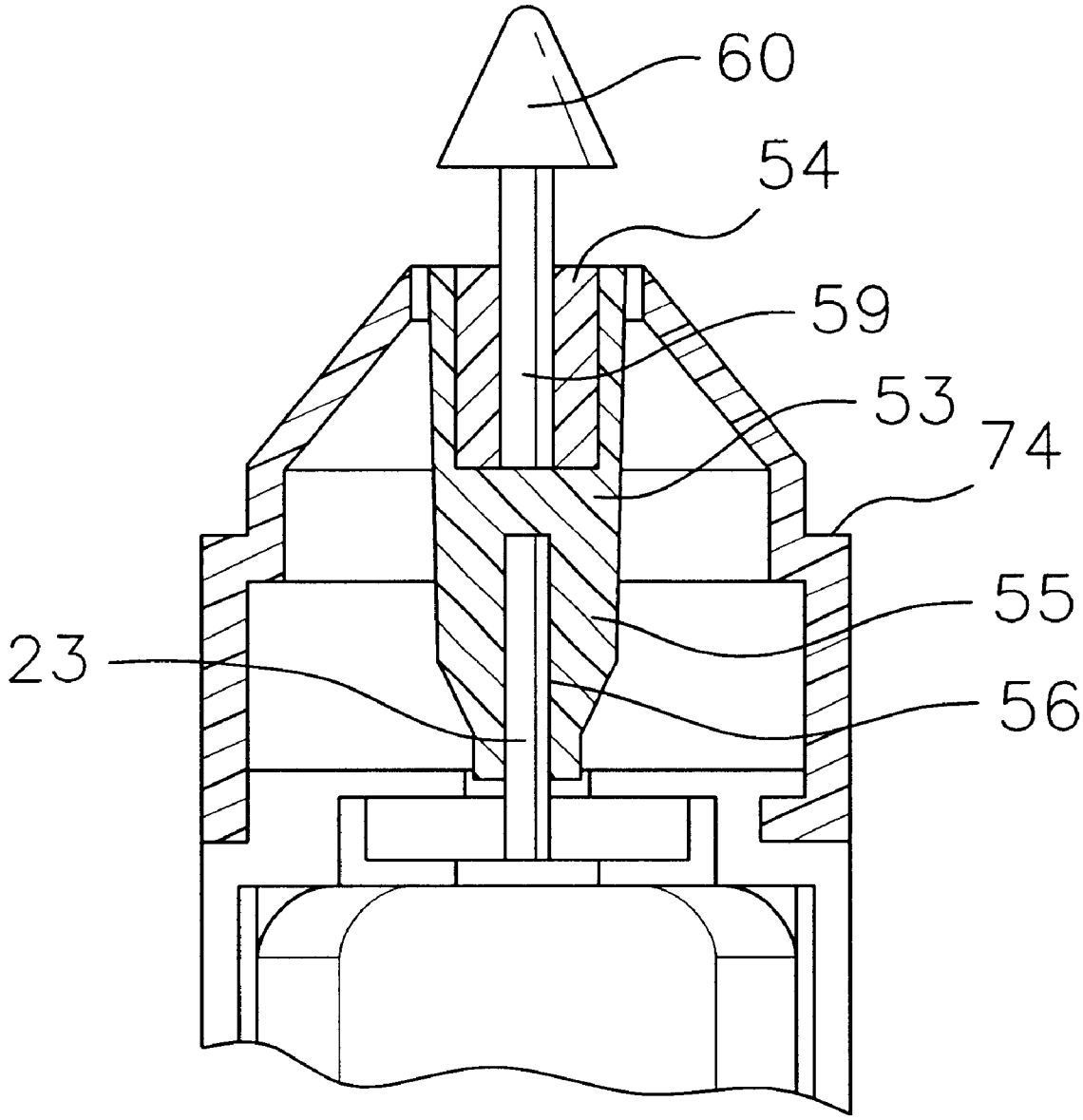
FIG. 6 is a cross sectional view showing the bit inserted into the inner sleeve of the spindle inside the spindle cover.
Figure 7:
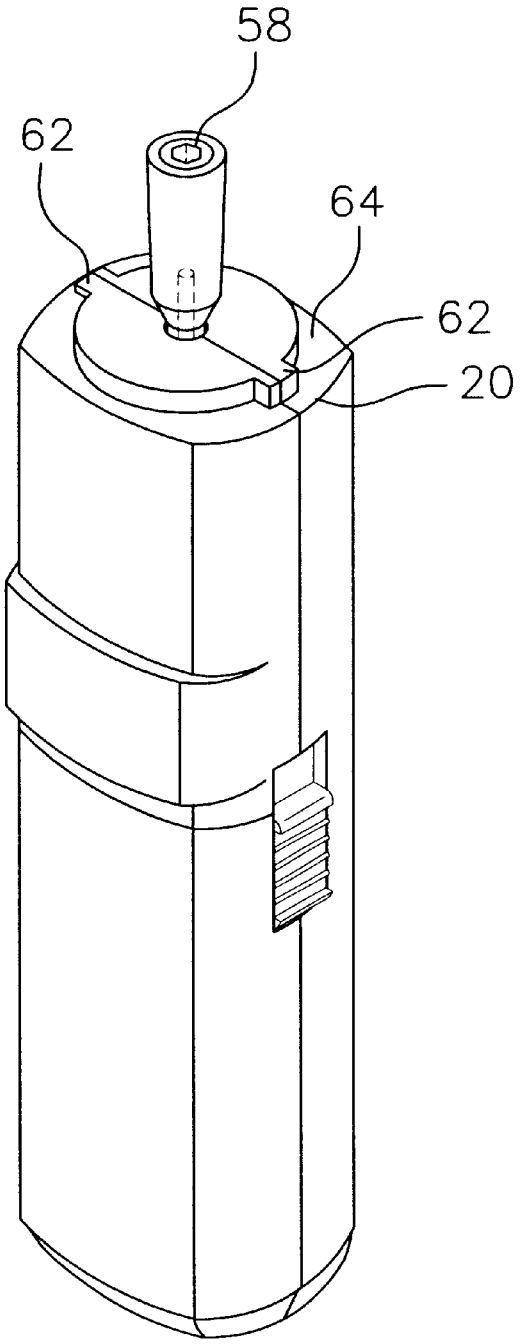
FIG. 7 is a perspective view of the spindle attached to the shaft with the bottom of the spindle inside the center hole of the elevated plate.
Figure 7A:
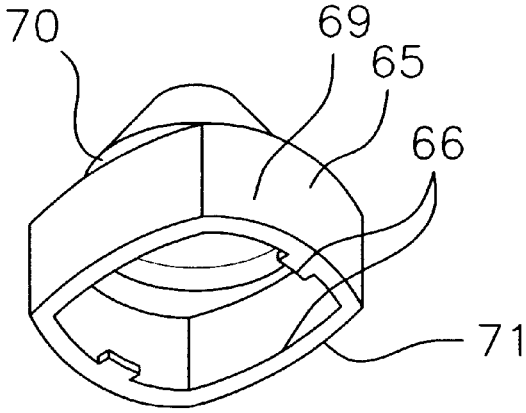
FIG. 7A is a perspective view of the inside bottom surface of the spindle cover.

A spindle 53, preferably made of plastic material, is inserted into the output shaft 23 of the motor 12. The spindle is cylindrical in shape or preferably slightly tapering at the bottom end to snugly fit into the shaft and prevent disengagement as shown in FIGS. 5 and 6. The spindle 53 has two compartments, a top 54 hollow compartment and a solid bottom 55 compartment having a vertical tubular opening 56 for receiving the shaft 23 as shown in FIG. 6. An inner sleeve 57, preferably made of silicone, is introduced into the hollow compartment 54. Other elastic or flexible materials such as rubber or latex may be used instead of silicone. The inner sleeve has a cylindrical outer surface having a diameter just slightly less than the inner diameter of the spindle to allow the inner sleeve to slide into the spindle but prevent it from inadvertently falling from the spindle. A thin film of adhesive, preferably acrylic based, is preferably applied or sprayed at the outer bottom surfaces of the inner sleeve to bond the inner sleeve to the spindle and prevent it from attaching to the grooming accessories when these are removed from the spindle. The inner surface or bore 58 of the inner sleeve may be cylindrical but it is preferably hexagonal in shape as shown in FIGS. 5 and 7 to allow firm gripping of the bit stem 59 but at the same time, allow easy removal during replacements. The bit stem 59 portion of the grooming accessory holds the bit head 60 which contains the different surfaces for grooming a fingernail. The bit head is the working tip that performs the nail grooming functions. The inner diameter of the inner sleeve must be the same or slightly less than the outer diameter of the bit stem. Because the inner sleeve is made up of silicone or equivalent elastic or flexible material, the bit stem will snugly fit into the inner sleeve. For the hexagonal bore, the distance between the edges of the opposite sides must be the same or slightly less than the outer diameter of the bit stem.

Figure 8:
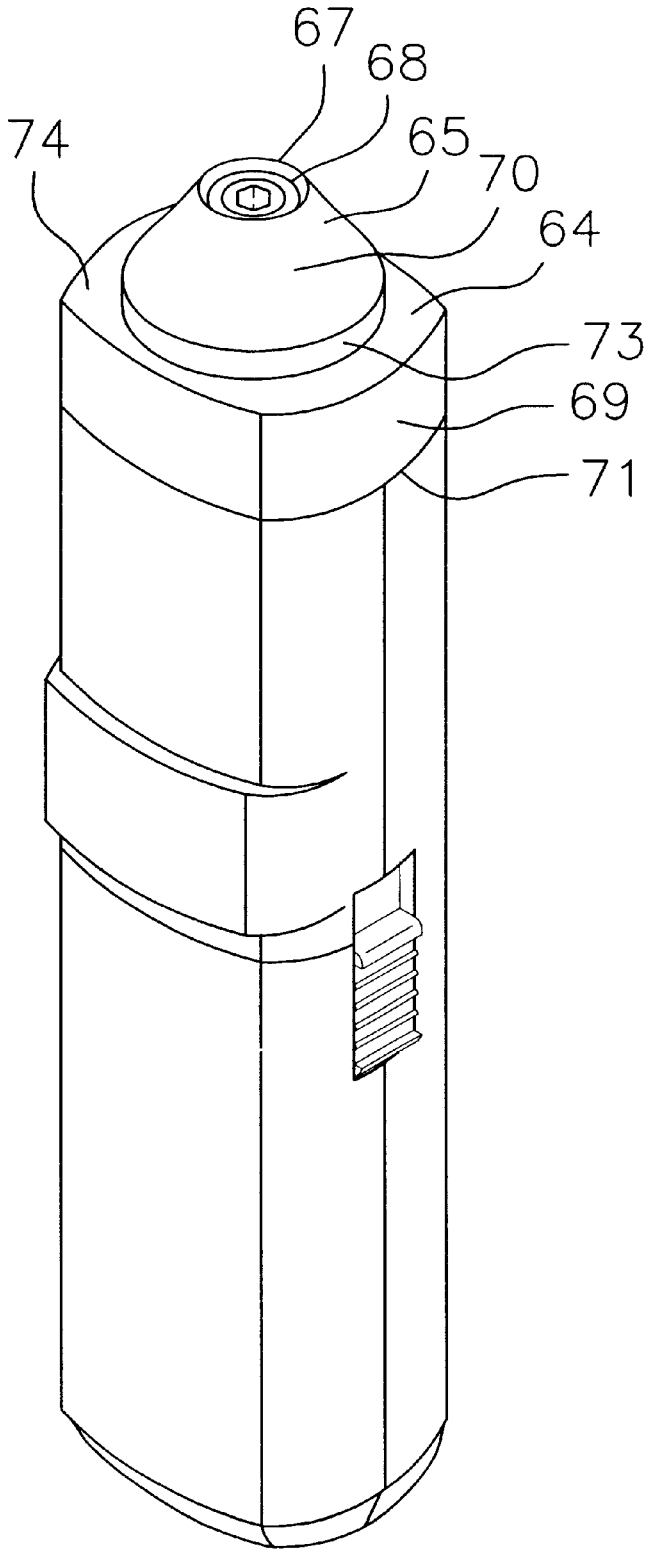
FIG. 8 is a perspective view showing the spindle with an inner sleeve inside the spindle cover.
Figure 9:
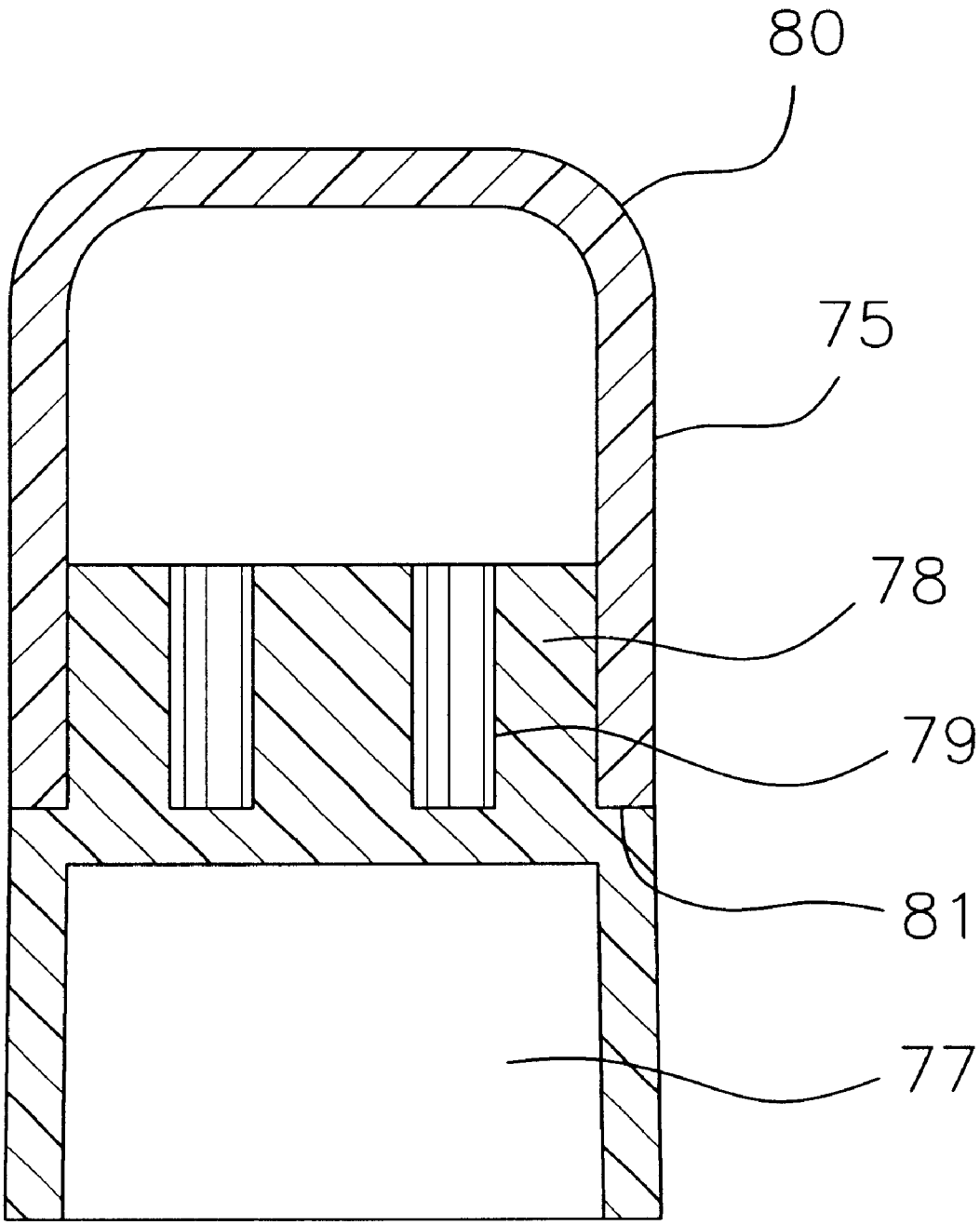
FIG. 9 is a cross sectional view of the cover covering the bit holder.

On the top surface of the handle 24 is molded, an elevated cylindrical plate 61 with a pair of earlike protrusions 62 on opposite sides as shown in FIG. 7. The plate 61 has a center 63 hole to allow the shaft and the spindle to go through. The bottom edge of the spindle slips into the center hole as shown in FIG. 7. The diameter of the center hole is greater than the diameter of the spindle to allow unimpeded rotation of the spindle when the device is in operation, that is, when the motor 12 is turned on. The plate 61 is elevated and recessed from the top surface of the handle such that the surfaces not covered by the plate serves as a flange 64 on which a spindle cover 65 rests after the inner surface 66 of the spindle cover snap fits or friction fits into the elevated plate 61. The tip 67 of the spindle cover 65 is at the same level or just slightly above the tip 68 of the spindle as shown in FIG. 8. The spindle cover protects the user from the rotating spindle and protects the motor as well from obstructed rotation when the device is on. The spindle cover 65 has a lower section 69 and an upper section 70. The lower section is shaped like the handle having the contour of its outside surface 71 matching the contour of the outside concaved surface 20 of the handle. The upper section 70 is preferably shaped like a frustum 72 on a cylindrical base 73 as shown in FIG. 5. The conical shape of the upper section allows for easy access of the bits to the fingernails. The circular base 73 has a diameter smaller than the shorter length across the lower section 69 as shown in FIGS. 5 and 8 thereby making the exposed outside surfaces 74 of the lower section 69 as a flange on which a bit holder 75 rests after the inner surface 76 of the bit holder snaps or friction fits into the cylindrical base 73 of the upper section 70 of the spindle cover as shown in FIG. 5. The bit holder may also contact the top surface 24 of the handle directly instead of the spindle cover. The plate 61 and the spindle cover 65 are preferably made of the same plastic material as the handle. Preferred plastic materials are those derived from polypropylene, acrylonitrile, butadiene and styrene. The bit holder 75 as shown in FIG. 5 is cylindrical in shape to match the geometric shape of the base 73 of the upper section 70 of the spindle cover. Alternately, the bit holder 75 should match the fastening means on the handle if this is connected directly to the handle instead of the spindle cover. Other geometric shapes are within the scope of this invention. The shape of the bit holder 75 should match the shape of the base 73 of the spindle cover if the attachment is by snap or friction fitting. If other fastening means are used, then it may not be necessary to match the geometric shapes of the bases of the spindle cover and the bit holder. The preferred bit holder 75 has two chambers, a hollow bottom chamber 77 for housing the upper section 70 of the spindle cover and a solid upper chamber 78 having tubular openings 79 for receiving a bit for each opening. The number of openings is at the discretion of the manufacturer and would depend upon the number of bits the holder has to store as well as the size of the upper chamber 78. The chambers of the bit holder may be molded in one piece or molded separately and later fused together. The height of the upper chamber 78 and consequently, the tubular openings 79 is preferably less than the height of the bit stem 59 so as to allow the bits to axially protrude from the tip of the upper chamber of the bit holder to enable one to easily remove and return a bit to the bit holder as shown in FIG. 1. To accommodate a cover 80 for the bit holder to keep the bits securely stored, the diameter of the solid upper chamber 78 of the bit holder is smaller than the diameter of the hollow lower chamber 77 so as to form another flange 81 from the top surface 82 of the hollow lower chamber 77 surrounding the bottom edge of the upper chamber 78. The cover 80 snaps or friction fits over the upper chamber 78 to engage circumferentially with the flange 81. The height of the cap is preferably just a little bit above the heights of the bits, that is, just a bit taller than the tallest bit, to prevent the tips from slipping out of the bit holder when the nail care device is stored at any position, for example, inside one's purse or bag, especially at the upside down position. The heights of the bits should be almost the same to prevent the shortest bit from slipping out of the bit holder. The cover 80 also keeps the bits from environmental factors such as dust, moisture, fumes, etc. The bit holder 75 and the cover 80 are preferably made of clear plastic material such as those derived from styrene acrylonitrile copolymer, polycarbonate, and polymethyl methacrylate for easy identification of the types of bit stored in the nail care device.

Figure 10:
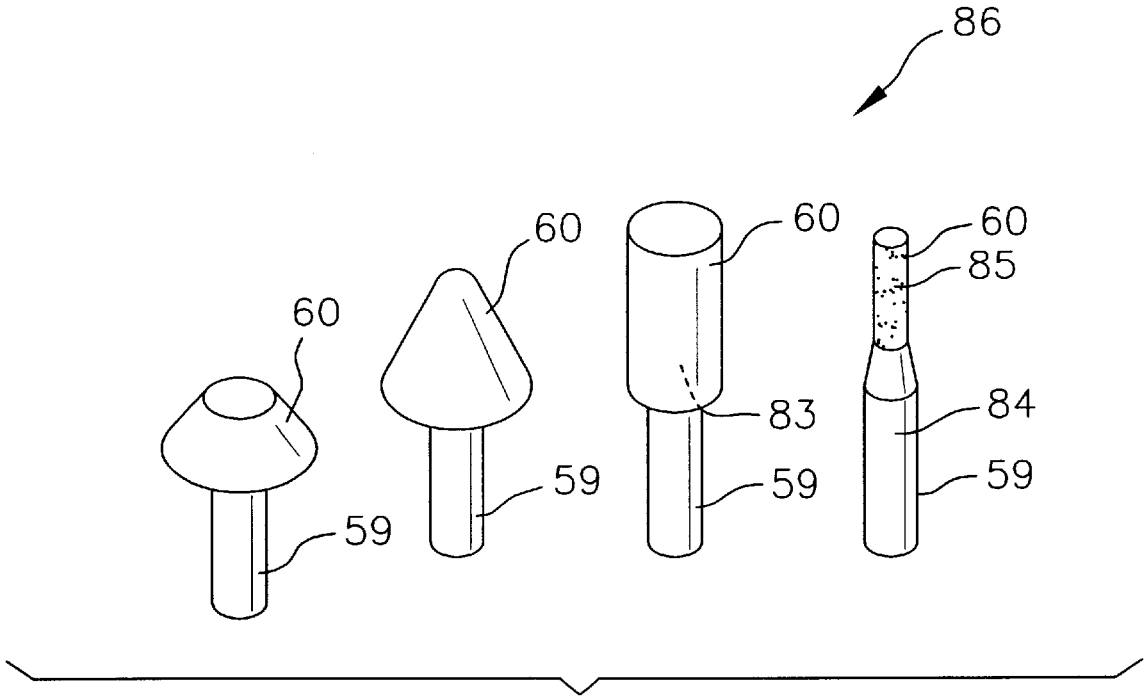
FIG. 10 shows some examples of bits or grooming accessories used with the nail care device.

The bits 86 are made preferably of a metal stem 59 such as steel on which a fingernail grooming head or bit head 60 is attached at the top end 83 of the stem 59 as shown in FIG. 10. The bit head is attached by glue to the top end 83 of the stem or the top end of the stem is etched according to a desired pattern as one found in metal nail files or as in the case of the cuticle remover bit 84 shown in FIG. 10, diamond particles are plated on a slender etched top end 85 of the stem. The materials making up the head 60 of the bit 86 varies according to their function. For example, typical materials used for filing, trimming and shaping are abrasive materials such as sapphire, abrasive stone, crude diamond, carbide, and carborundum while materials for buffing, polishing and cleaning are nonabrasive such as pressed cotton or pressed fabric material or wood. The shape of the bit heads also vary according to its desired function. These head may be cylindrical, wedged shape, crescent shape, disc shaped, frustum shaped, conical, etc. The preferred glue for sticking the bit head 60 to the bit stem 59 is a mixture of epoxy, ethylamine, benzyl and grit powder.

To use the nail care device, a user opens the cover or cap 80, selects the bit 86 appropriate for the desired grooming function and inserts this bit to the inner sleeve 57 of the spindle. The user then turns on the switch 15 to start the electric motor 12 that rotates the shaft 23 and consequently, the spindle 53 that is attached to the shaft. The bit head 60 is then brought into contact with the fingernail surface that the user desires to groom until the desired function is achieved, at which point the switch is turned off to stop the motor.

The nail care device may also be used manually without triggering the motor when rotation of the bit head is not required or preferred.

The nail care device as shown here is designed for a portable hand held device but this may be manufactured in any desired size.

While the embodiment of the present invention has been described, it should be understood that various changes, modifications and adaptations may be made therein without departing from the spirit of the invention and the scope of the appended claims. Those skilled in the art will recognize that other and further variations of the features presented herein are possible. The scope of the present invention should be determined by the teachings disclosed herein, the appended claims and their legal equivalents.

I claim:

1. A compact one piece nail care device assembly comprising:

a handle housing a motor having an output shaft and a power supply;

a spindle having two compartments, a top hollow compartment, the top hollow compartment having an insertable inner sleeve for snugly fitting a removable grooming accessory referred to as bit having a bit head and a bit stem, and a solid bottom compartment having a vertical tubular opening for receiving the shaft;

a bit holder attaching on top of the handle for carrying and storing the bit;

a cover for the bit holder to secure the bit inside the bit holder;

means for powering the motor;

means for triggering the device; and, means for attaching parts of the nail care device assembly together.

2. The nail care device of claim 1 wherein the power supply is selected from the group consisting of nonrechargeable battery, rechargeable battery and plugging into an electric current.

3. The nail care device of claim 1 wherein the triggering device is a switch.

4. The nail care device of claim 3 wherein the switch comprise of two parallel rectangular strip joined by a bridge, the bridge sliding through a longitudinal track when the parallel strips slide upwards or downwards on the track.

5. The nail care device of claim 1 wherein the handle comprise of a back half piece and a front half piece, the front half piece formed by two detachable pieces.

6. The nail care device of claim 1 wherein the inner sleeve has a cylindrical inner and outer surface.

7. The nail care device of claim 1 wherein the inner sleeve has a cylindrical outer surface and a hexagonal inner surface.

8. The nail care device of claim 1 wherein the inner sleeve is made of a flexible elastic material.

9. The nail care device of claim 1 further comprising a spindle cover attached to the handle for protecting the spindle and the motor when the nail care device is in operation.

10. The nail care device of claim 9 wherein the bit holder attaches on top of the spindle cover.

11. The nail care device of claim 1 wherein the bit holder includes a plurality of tubular openings for receiving the bit.

12. The nail care device of claim 1 wherein the cover has a height just slightly above all heights of the bits stored in the bit holder.

13. The nail care device of claim 1 wherein the bit head is attached to the bit stem by a glue comprising of a mixture of epoxy, ethylamine, benzyl and grit powder.

14. The nail care device of claim 1 wherein the bit head is made of abrasive material.

15. The nail care device of claim 1 wherein the bit head is made of nonabrasive material.

16. The nail care device of claim 1 wherein the bit is the bit stem having a top end etched with a pattern.

17. The nail care device of claim 1 wherein the bit comprises diamond particles plated on a slender etched top end of the bit stem.

18. A compact one piece nail care device assembly comprising:

a handle housing a motor having an output shaft and a power supply;

a spindle having two compartments, a top hollow compartment for receiving an inner sleeve, the inner sleeve having a hexagonal tubular opening for receiving a removable grooming accessory referred to as bit having a bit stem and a bit head, and a solid bottom compartment for receiving the shaft;

a spindle cover attached to the handle for protecting the spindle and the motor when the nail care device is in operation;

a bit holder attaching on the handle or the spindle cover, the bit cover holder having a plurality of tubular openings for carrying and storing the bit;

a cover for the bit holder to secure the bit inside the bit holder, the cover having a height just slightly above all heights of the bits stored in the bit holder;

means for powering the motor;

means for triggering the device; and, means for attaching parts of the nail care device assembly together.

* * * * *